US008746455B2

(12) United States Patent
Chia et al.

(10) Patent No.: US 8,746,455 B2
(45) Date of Patent: Jun. 10, 2014

(54) PILL CONTAINER AND PILL STORING ASSEMBLY

(76) Inventors: Le-Chi Chia, Taipei (TW); Le-Shin Chang, Taipei (TW)

( * ) Notice: Subject to any disclaimer, the term of this patent is extended or adjusted under 35 U.S.C. 154(b) by 247 days.

(21) Appl. No.: 13/419,166

(22) Filed: Mar. 13, 2012

(65) Prior Publication Data

US 2012/0168343 A1 Jul. 5, 2012

Related U.S. Application Data

(63) Continuation-in-part of application No. 12/555,542, filed on Sep. 8, 2009, now abandoned.

(51) Int. Cl.
*B65D 83/04* (2006.01)

(52) U.S. Cl.
USPC ..... 206/534; 206/536; 206/534.2; 206/509; 206/807

(58) Field of Classification Search
USPC ..... 206/528, 534, 534.1, 534.2, 536, 538, 206/533, 540, 459.5, 506, 507, 1.5, 807, 206/509
See application file for complete search history.

(56) References Cited

U.S. PATENT DOCUMENTS

| | | | | | |
|---|---|---|---|---|---|
| 1,440,046 | A | | 12/1922 | Ziplinsky | |
| 2,766,796 | A | | 10/1956 | Tupper | |
| 3,042,256 | A | * | 7/1962 | Sanner | 221/301 |
| 3,537,422 | A | | 11/1970 | Moe | |
| 3,703,955 | A | | 11/1972 | Inacker | |
| 4,062,445 | A | | 12/1977 | Moe | |
| 4,083,452 | A | * | 4/1978 | Rossmo | 206/533 |
| 4,245,742 | A | * | 1/1981 | Rossmo | 206/534 |
| 4,334,617 | A | * | 6/1982 | Rossmo | 206/534 |
| 4,418,823 | A | | 12/1983 | Romick | |
| 4,793,492 | A | * | 12/1988 | Halbich | 206/538 |
| 4,838,625 | A | * | 6/1989 | Taylor | 312/249.5 |
| 5,669,503 | A | * | 9/1997 | Robin | 206/528 |
| 5,782,359 | A | * | 7/1998 | McAllister et al. | 206/538 |
| 5,899,335 | A | * | 5/1999 | Boyer et al. | 206/538 |
| 5,921,394 | A | * | 7/1999 | Shroff | 206/534 |
| 6,244,439 | B1 | * | 6/2001 | Dennis | 206/457 |
| 7,121,404 | B2 | * | 10/2006 | Huang | 206/278 |
| 7,156,226 | B1 | * | 1/2007 | Van Sickle | 206/216 |
| 7,464,819 | B2 | * | 12/2008 | Maietta | 206/536 |
| 7,854,326 | B1 | | 12/2010 | Beckett | |
| 2004/0069787 | A1 | * | 4/2004 | Gruennert et al. | 220/503 |
| 2005/0045519 | A1 | * | 3/2005 | Hirsch | 206/534 |
| 2005/0269237 | A1 | * | 12/2005 | Tung et al. | 206/534 |
| 2006/0086641 | A1 | | 4/2006 | Priebe et al. | |
| 2009/0166243 | A1 | * | 7/2009 | Cetera | 206/528 |

* cited by examiner

*Primary Examiner* — Jacob K Ackun
(74) *Attorney, Agent, or Firm* — DLA Piper LLP (US)

(57) ABSTRACT

A pill container includes: a container body defining a pill-storing space for storing pills therein and having a plurality of sides, top and bottom walls and a plurality of first side walls interconnecting the top and bottom walls, and disposed respectively at corresponding ones of the sides, each of the first side walls being formed with an access opening for access into the pill-storing space; a plurality of first doors connected to the first side walls for closing and opening the access openings in the first side walls, respectively; and a plurality of different first marks, each of which is provided on a respective one of the first side walls or a respective one of the first doors. The first marks respectively represent different times of a day for taking the pills.

20 Claims, 6 Drawing Sheets

PILL CONTAINER AND PILL STORING ASSEMBLY

CROSS-REFERENCE TO RELATED APPLICATION

This application is a continuation-in-part (CIP) of co-pending U.S. patent application Ser. No. 12/555,542, filed by the applicant on Sep. 8, 2009.

BACKGROUND OF THE INVENTION

1. Field of the Invention

The invention relates to a pill container and a pill storing assembly including a stack of the pill containers, and more particularly to a pill container having different marks provided on doors or side walls of the pill container and arranged in a time ordered manner.

2. Description of the Related Art

U.S. Pat. No. 3,537,422 discloses a dispenser for medical preparations. The dispenser includes a body divided into a plurality of compartments that are defined by a plurality of partitions and ribs and that are arranged into rows and columns. Each of the rows has four consecutive compartments for breakfast, lunch, dinner, and supper. Each column of the compartments is covered with a cover that is slidable stepwise relative to the dispenser body along the column so that the compartments which are delimited from each other are uncovered one after the other. The dispenser body has a time indication at each compartment showing the time the content thereof is to be taken. The aforesaid dispenser is disadvantageous in that since each compartment is designed to store different pills to be taken at a corresponding time, such as breakfast time, lunch time, supper time or bed time, for each day of a prescribed period, it is time consuming and laborious to distribute the different pills into each compartment and prescription pills may be misplaced in a wrong pill container (s). In addition, since the dispenser is normally designed for a prescribed period of time of taking pills, the number of the compartments of each column can be relatively large, which undesirably increases the volume of the dispenser. Reduction of the number of the compartments of each column of the dispenser can increase the replenishment number.

SUMMARY OF THE INVENTION

Therefore, the object of the present invention is to provide a pill container that can overcome the aforesaid drawbacks associated with the prior art.

According to one aspect of the present invention, there is provided a pill container that comprises: a container body defining a pill-storing space adapted for storing pills therein and having a plurality of sides, top and bottom walls, and a plurality of first side walls interconnecting the top and bottom walls and disposed respectively at corresponding ones of the sides, each of the first side walls being formed with an access opening for access into the pill-storing space; a plurality of first doors connected to the first side walls for closing and opening the access openings in the first side walls, respectively; and a plurality of different first marks, each of which is provided on a respective one of the first side walls or a respective one of the first doors. The first marks respectively represent different times of a day for taking the pills.

According to another aspect of the present invention, there is provided a pill storing assembly that comprises a plurality of pill containers adapted for storing different types of pills, respectively, and an interconnecting mechanism. Each of the pill containers includes: a container body defining a pill-storing space and having a plurality of sides, top and bottom walls, and a plurality of first side walls interconnecting the top and bottom walls and disposed respectively at corresponding ones of the sides, the top and bottom walls being opposite to each other in an alignment direction, each of the first side walls being formed with an access opening for access into the pill-storing space; a plurality of first doors connected to the first side walls for closing and opening the access openings in the first side walls, respectively; and a plurality of different first marks, each of which is provided on a respective one of the first side walls or a respective one of the first doors. The first marks respectively represent different times of a day for taking the pills. The interconnecting mechanism interconnects the container bodies of the pill containers to forma stack that has a plurality of lateral sides. The interconnecting mechanism has a fool-proof function such that when the stack is formed, the first side walls which are disposed at one of the lateral sides of the stack are aligned along the alignment direction, and that the times represented by the first marks which are disposed at the one of the lateral sides of the stack are always the same.

BRIEF DESCRIPTION OF THE DRAWINGS

In drawings which illustrate embodiments of the invention.

DETAILED DESCRIPTION OF THE PREFERRED EMBODIMENTS

Figure 1:
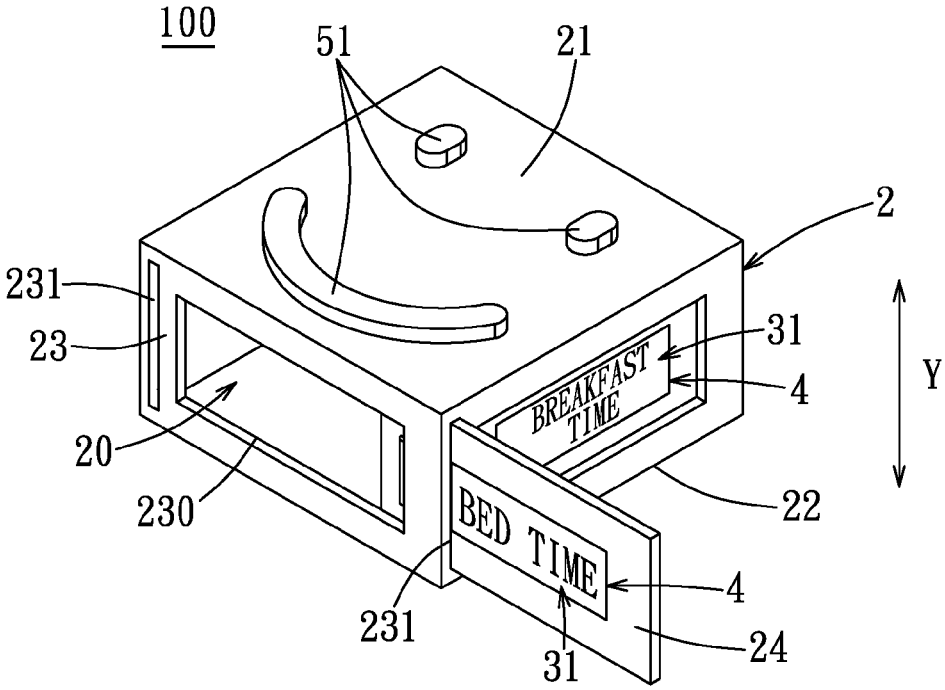
FIG. 1 is a perspective view of the first preferred embodiment of a pill container according to the present invention, viewed from one side.

Before the present invention is described in greater detail with reference to the accompanying preferred embodiments, it should be noted herein that like elements are denoted by the same reference numerals throughout the disclosure.

Figure 2:
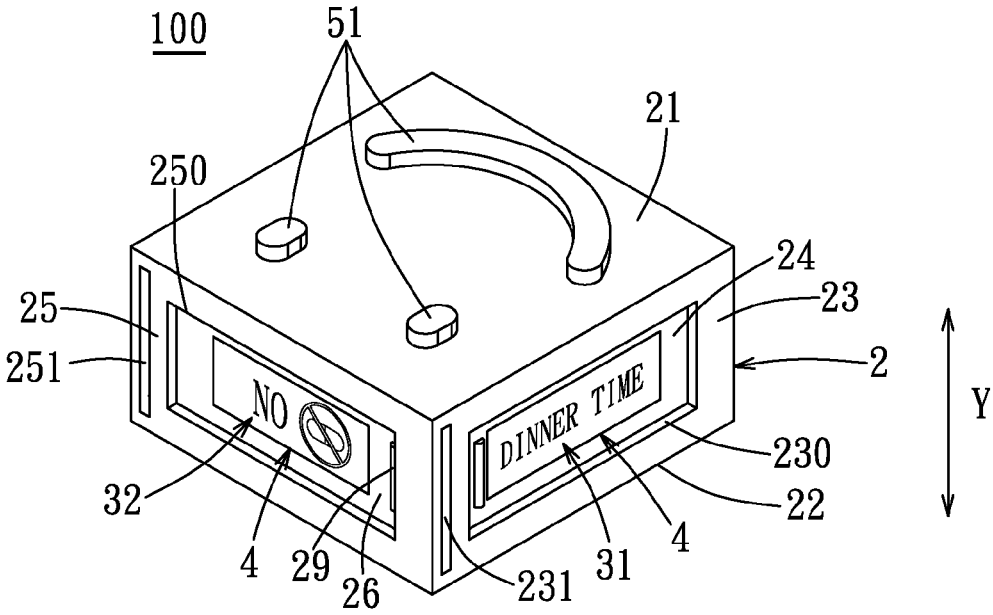
FIG. 2 is a perspective view of the first preferred embodiment, viewed from another side.
Figure 3:
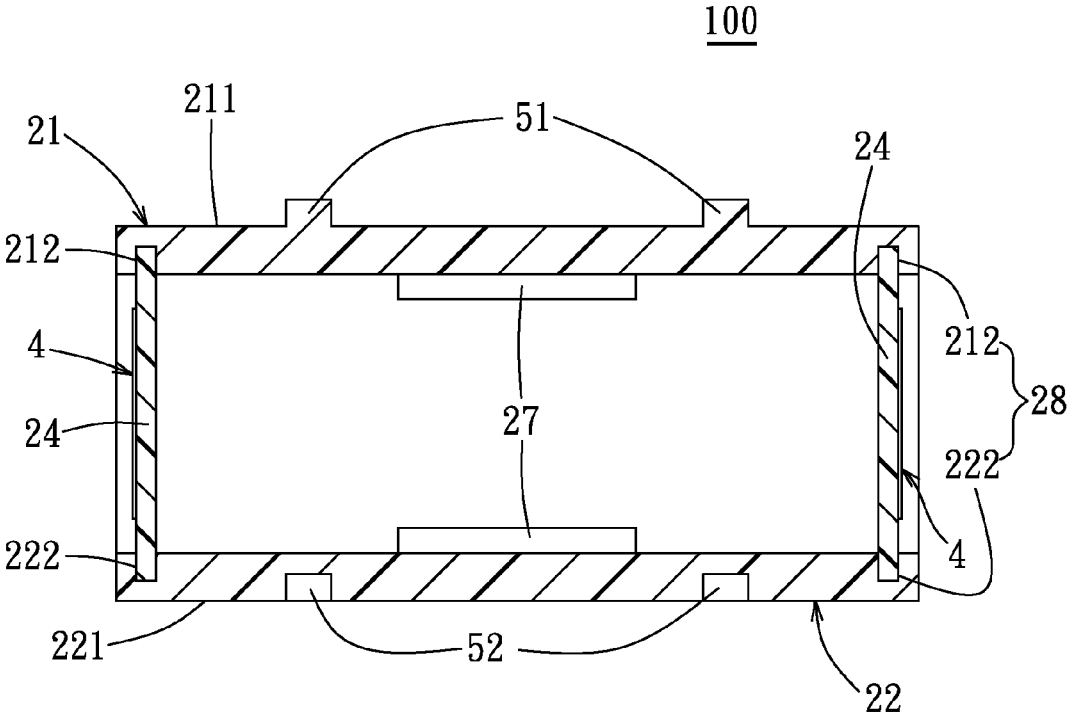
FIG. 3 is a sectional view of the first preferred embodiment.

FIGS. 1 to 3 illustrate the first preferred embodiment of a portable pill container 100 according to the present invention. The pill container 100 includes: a container body 2 defining a pill-storing space 20 for storing pills (not shown) therein and having a plurality of sides (that cooperatively define a polygonal shape), top and bottom walls 21, 22, and a plurality of first side walls 23 interconnecting the top and bottom walls 21, 22 and disposed respectively at corresponding ones of the sides, each of the first side walls 23 being formed with an access opening 230 for access into the pill-storing space 20; a plurality of first doors 24 connected to the first side walls 23 for closing and opening the access openings 230 in the first side walls 23, respectively; and a plurality of different first marks 31, each of which is provided on a respective one of the first side walls 23 or a respective one of the first doors 24. The first marks 31 are characters, words, symbols, numbers, pictures or figures, and respectively represent different times of a day for taking the pills stored in the pill container 100.

In this embodiment, a plurality of labels 4 are attached to the first doors 24, respectively, and the first marks 31 are marked on the labels 4, respectively. Alternatively, the first marks 31 can be directly printed on the first doors 24 or the first side walls 23.

The times represented by the first marks 31 are arranged in a time ordered manner along a clockwise or a counterclockwise direction. For example, when the pill container 100 is square in shape and has four first doors 24 respectively disposed at four sides of the pill container 100, the first marks 31 attached to the first doors 24 can use words "BREAKFAST", "LUNCHTIME", "DINNER TIME", and "BED TIME" to represent the times, and can be arranged in the above order along the clockwise or counterclockwise direction.

The top and bottom walls 21, 22 are opposite to each other in an alignment direction (Y) and have outer surfaces 211, 221, respectively. The pill container 100 further includes a first engaging member 51 provided at the outer surface 211 of the top wall 21 and having a fool-proof pattern, and a second engaging member 52 provided at the outer surface 221 of the bottom wall 22 and having a fool-proof pattern that overlaps the fool-proof pattern of the first engaging member 51 in the alignment direction (Y).

Each of the top and bottom walls 21, 22 is provided with a magnet 27 for attachment purpose.

Each of the first doors 24 is slidable relative to the container body 2 in a transverse direction relative to the alignment direction (Y) for closing and opening the access opening 230 in the respective one of the first side walls 23.

Preferably, each of the first side walls 23 is formed with a slit 231 extending between the top and bottom walls 21, 22 in the alignment direction (Y) for extension of a respective one of the first doors 24 therethrough that is disposed at an adjacent one of the first side walls 23. An assembly of the top and bottom walls 21, 22 is formed with a plurality of guiding tracks 28, each of which includes a pair of guiding grooves 212, 222 formed in the top and bottom walls 21, 22, respectively. Each of the first doors 24 extends slidably into the guiding grooves 212, 222 of a respective one of the tracks 28.

In this embodiment, the container body 2 further has one second side wall 25 that is disposed at a corresponding one of the sides of the container body 2, that is disposed between two adjacent ones of the first side walls 23, that interconnects the top and bottom walls 21, 22 and that is formed with an access opening 250. A second door 26 is fixed to the second side wall 25 for permanently closing the access opening 250 in the second side wall 25. A second mark 32 is provided on a label 4 on the second door 26, and represents an indication of no need to take the pills stored in the pill container 100 at a time between two adjacent times represented by two adjacent ones of the first marks 31. For example, when the first marks 31 disposed adjacent to the second mark 32 respectively represent the "BREAKFAST TIME" and the "DINNER TIME", the second mark 32 can be a "FORBIDDEN" sign or a "NO" sign representing an indication that it is not necessary to take the pill (s) stored in the pill container 100 at the lunch time. The second side wall 25 is formed with a slit 251 extending between the top and bottom walls 21, 22 in the alignment direction (Y) for extension of an adjacent one of the first doors 24 therethrough that is disposed at an adjacent one of the first side walls 23. A stopper 29 protrudes from the second doors 26 to prevent the latter from sliding relative to the second side wall 25.

Figure 4:
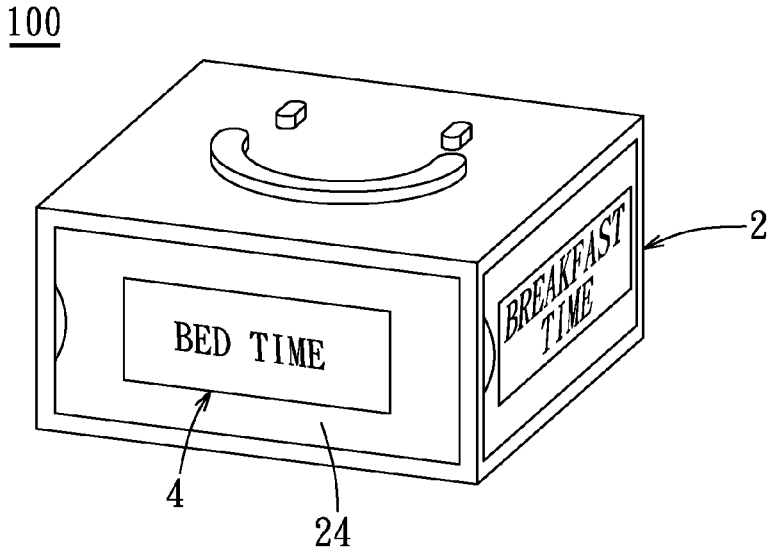
FIG. 4 is a perspective view of the second preferred embodiment of a pill container according to the present invention, illustrating a state where a first door is disposed at a close position.
Figure 5:
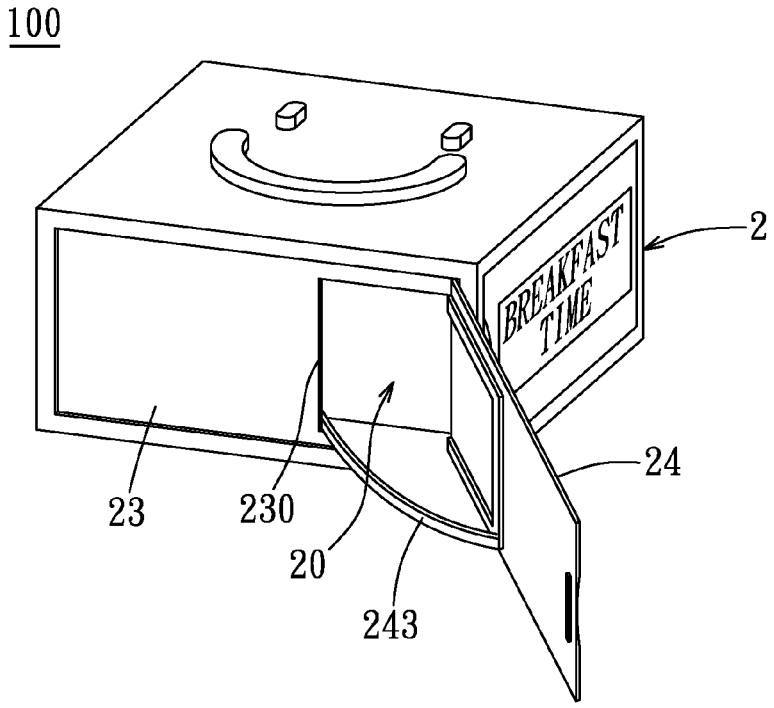
FIG. 5 is a perspective view of the second preferred embodiment, illustrating a state where the first door is disposed at an open position.

FIGS. 4 and 5 illustrate the second preferred embodiment of a portable pill container 100 according to the present invention. The second preferred embodiment differs from the previous embodiment in that each of the first doors 23 is pivotable relative to the container body 2 for closing and opening the access opening 230 in the respective one of the first side walls 23. Each of the first doors 24 is provided with a pill-receiving tray 243 protruding therefrom. The pill-receiving tray 243 is disposed in the pill-storing space 20 when the first door 24 is disposed at a close position (see FIG. 4), and is disposed outwardly of the pill-storing space 20 when the first door 24 is disposed at an open position (see FIG. 5).

Figure 6:
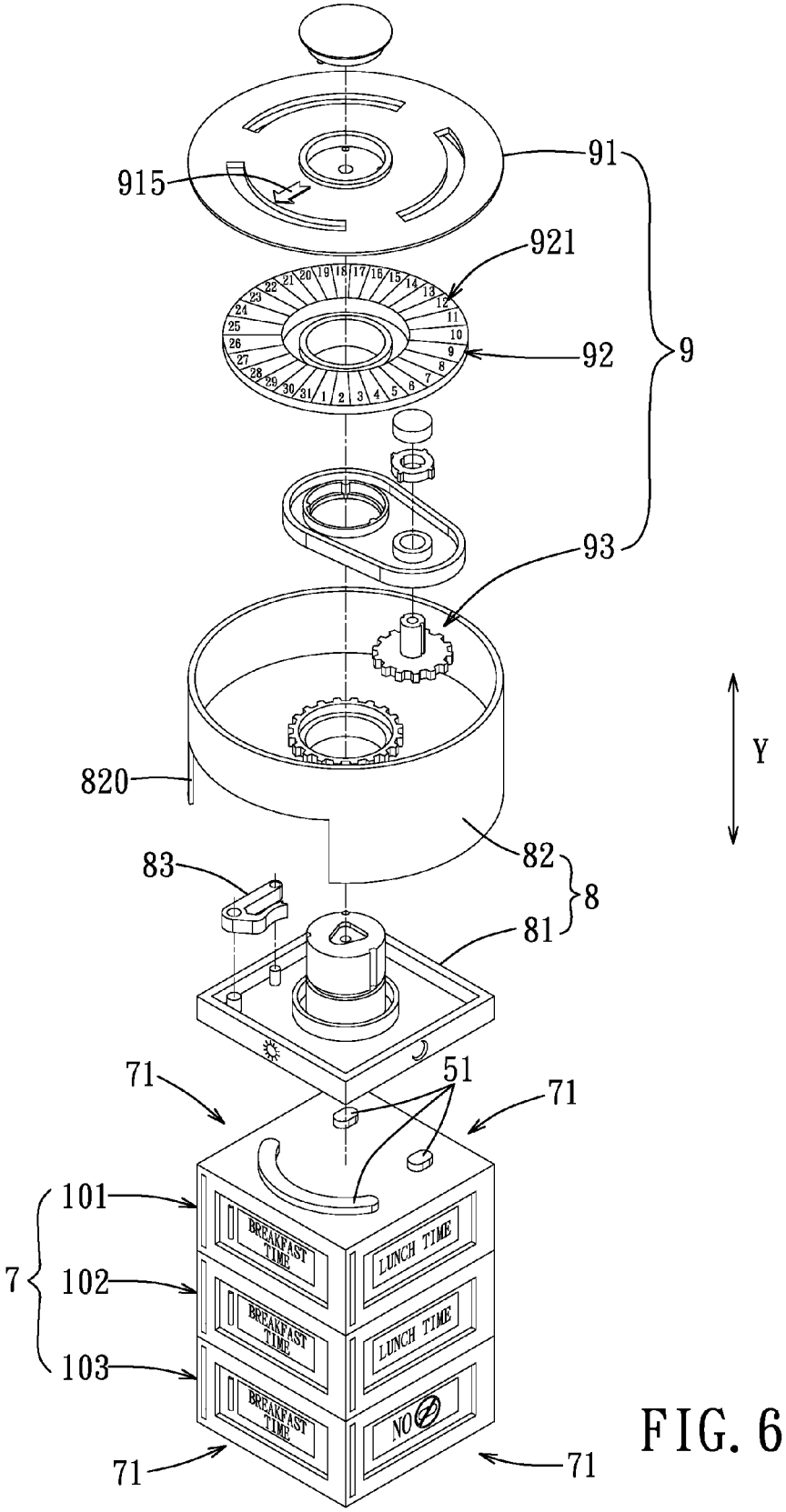
FIG. 6 is an exploded perspective view of a pill storing assembly including pill containers having a structure similar to that of the first preferred embodiment.
Figure 7:
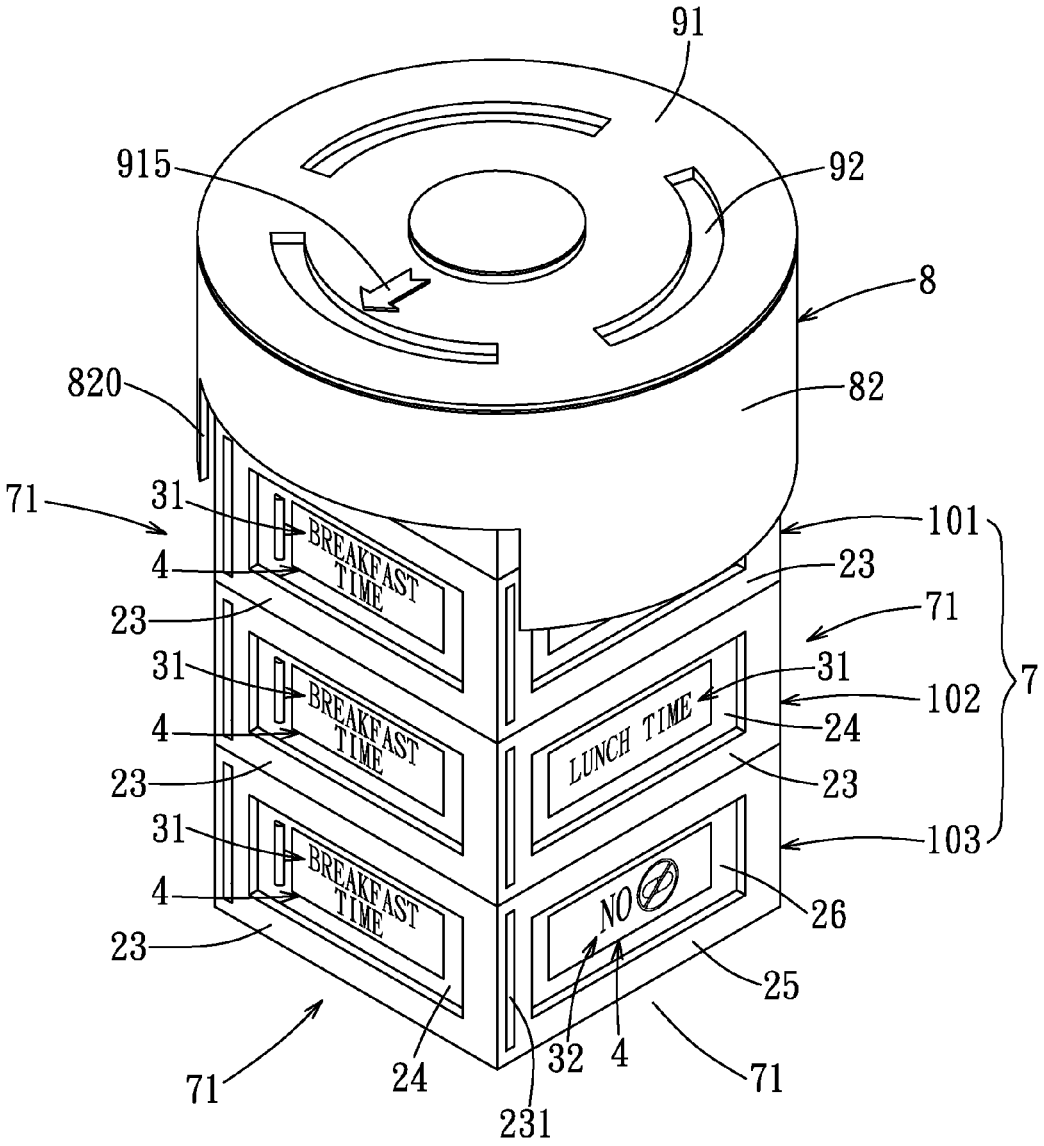
FIG. 7 is an assembled perspective view of the pill storing assembly.
Figure 8:
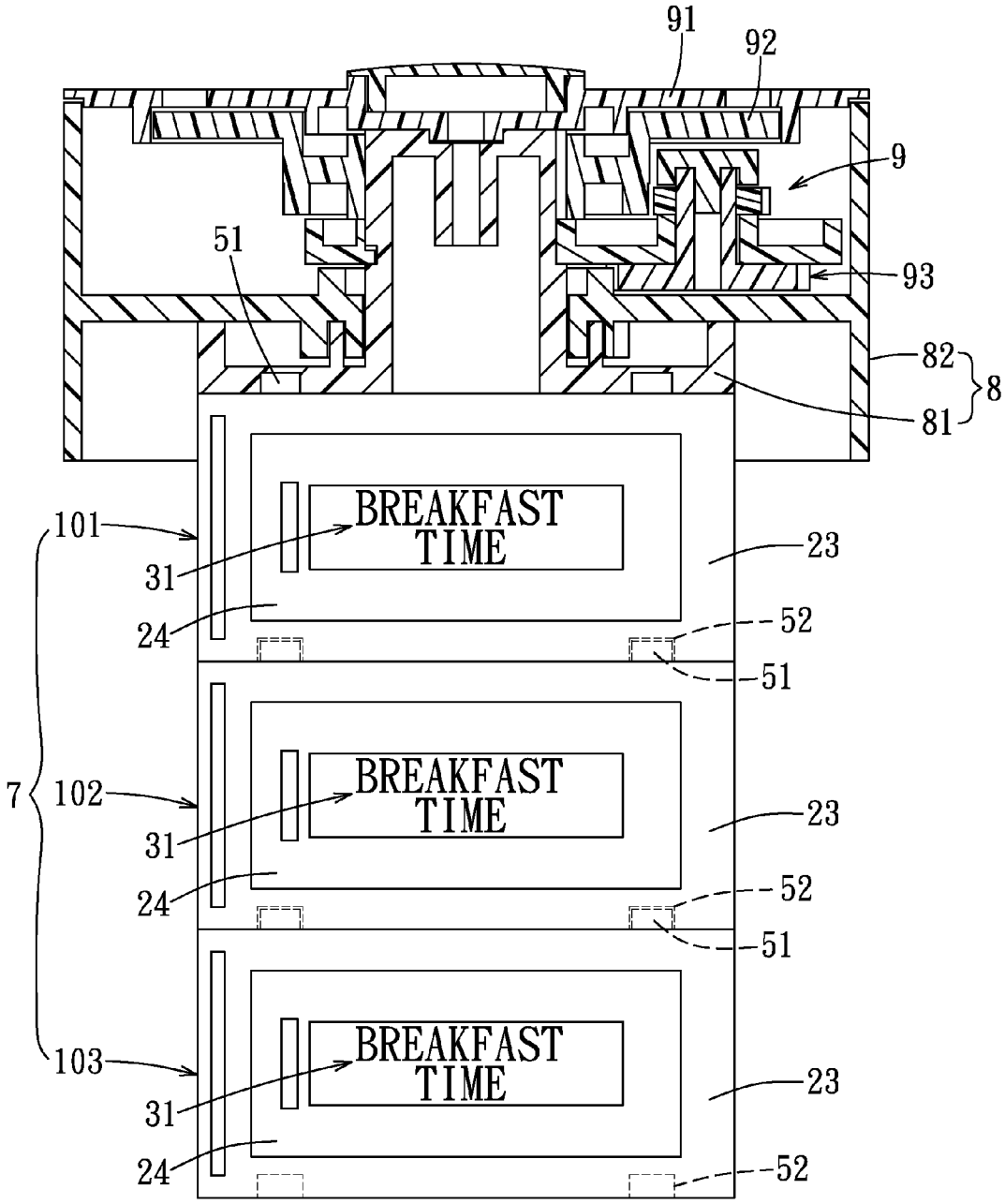
FIG. 8 is a sectional view of the pill storing assembly.

FIGS. 6 to 8 illustrate a pill storing assembly including three pill containers 101, 102, 103 adapted for storing three different types of pills, respectively. The number of the pill containers used for the pill storing assembly can be increased according to the actual requirements. For example, the number of the pill containers will be five when there are five different types of pills to be taken by the user during a therapy, each pill container storing one type of the pills. In addition, there are four types of administered times per day, including four times a day (qid: breakfast time, lunch time, dinner time, and bed time), three times a day (tid: breakfast time, lunch time and dinner time), two times a day (bid: breakfast time and dinner time), and one time a day (qd: breakfast time or bed time). The pill containers 101, 102, 103 shown in FIGS. 6-8 are used to store the pills that are to be taken four times a day, three times a day and two times a day, respectively. It is noted that the administered times marked on each of the pill containers 101, 102, 103 can be any one of the four types of administered times per day according to the actual requirements.

Each pill container preferably has a volume that can accommodate a number of pills for at least one day or even several months.

The pill containers 101, 102, 103 of the pill storing assembly have a structure similar to that of the pill container 100 of the first preferred embodiment, but differ from each other in the numbers of the first and second side walls 23, 25, the numbers of the first and second doors, 24, 26, and the numbers of the first and second marks 31, 32. The pill container 101 has four first side walls 23, four first doors 24, and four first marks 31 (i.e., the pill container 101 does not have the second side wall 25, the second door 26 and the second mark 32). The pill container 102 has three first side walls 23, three first doors 24, three first marks 31, one second side wall 25, one second door 26 and one second mark 32. The pill container 103 has two first side walls 23, two first doors 24, two first marks 31, two second side walls 25, two second doors 26 and two second marks 32. The first and second side walls 23, 25 of the pill container 103 are alternatively disposed.

Each of the pill containers 101, 102, 103 has a first engaging member 51 and a second engaging member 52 that are similar to those of the pill container 100, respectively. The first engaging member 51 of one of the pill containers 101, 102, 103 is engageable with the second engaging member 52 of another one of the pill containers 101. Hence, the first and second engaging members 51, 52 of the pill containers 101, 102, 103 can cooperatively define an interconnecting mechanism for interconnecting the container bodies 2 of the pill containers 101, 102, 103 to form a stack 7 that has four lateral sides 71. It is noted that the stacking order of the pill containers 101, 102, 103 can be randomly disposed.

Each of the first and second engaging members 51, 52 of each of the pill containers 101, 102, 103 has a fool-proof pattern. The fool-proof patterns of the first and second engaging members 51, 52 of the pill containers 101, 102, 103 of the stack 7 overlap each other in the alignment direction (Y) so that the interconnecting mechanism thus formed has a fool-proof function that permits the first side walls 23 of the pill containers 101, 102, 103 which are disposed at one of the lateral sides 71 of the stack 7 to be aligned along the alignment direction (Y) and further permits the times represented by the first marks 31 of the pill containers 101, 102, 103 which are disposed at the one of the lateral sides 71 of the stack 7 are always the same. For example, as shown in FIG. 6, the first marks 31 of the three pill containers 101, 102, 103 that represent the "Breakfast time" sign are all disposed at one of lateral sides 71 of the stack 7, and the first marks 31 of the pill containers 101, 102 that represent the "lunchtime" sign are all disposed at another of the lateral sides 71 of the stack 7. Note that the pill container 103 does not have the first mark 31 that represents the "lunch time" sign, but instead has the second mark 32 that represents the "NO" sign disposed between the first marks 31 that represent the "breakfast time" sign and the "dinner time" sign (not shown).

The pill storing assembly further includes a misuse-prevention mechanism 8 and a date-tracking mechanism 9. The misuse-prevention mechanism 8 includes a base 81 mounted on a top end of the stack 7, and a sleeve 82 that is mounted rotatably on the base 81 and that partially surrounds the first side walls 23 of the container body 2 of the pill container 101. The sleeve 82 is formed with a bottom notch 820 and is rotatable relative to the stack 7 in a clockwise direction so as to position the bottom notch 820 at a selected one of the lateral sides 71 of the stack 7 so that none of the first side walls 23 of the container bodies 2 of the pill containers 101, 102, 103 which are disposed at the selected one of the lateral sides 71 is surrounded by the sleeve 82, thereby permitting the user to access the different pills stored in the pill containers 101, 102, 103 through the access openings 230 in the first side walls 23 aligned with the bottom notch 820. A direction-limiting element 83 is mounted on the base 81 and is engageable with the sleeve 82 in a manner to prevent the sleeve 82 from rotating in a counterclockwise direction. The date-tracking mechanism 9 includes a top cover 91 with a pointer 915, a date gearwheel 92 having a calendar 921, and a gear mechanism 93. The top cover 91 is disposed on a top end of the sleeve 82 and is coupled to the base 81. The date gearwheel 93 is mounted rotatably in the sleeve 82. The gear mechanism 93 is mounted in and connected to the sleeve 82 and engages the date gear wheel 92 so that when the sleeve 82 rotates one full turn in the clockwise direction, the date gear wheel 92 is driven to rotate an angle to align a next day of the calendar 921 with the pointer 915 so as to ensure the user to take the pills correctly with respect to the set date and time. In addition, the top cover 91 can be provided with a reminder or an indicator (not shown) to inform the user when was the last time the pills were taken.

With the inclusion of multiple first openings 230 in the first side walls 23, and multiple first doors 24 and multiple first marks 31 in the pill container 100 of this invention, the pill containers 101, 102, 103 with different numbers of the first and second marks 31, 32 based on actual requirements for storing different types of the pills can be assembled into a stack 7 that can ensure the user to take the different pills correctly with respect to the set date and time, which can overcome the aforesaid drawbacks associated with the prior art.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A portable pill container comprising:

a container body defining a pill-storing space adapted for storing pills therein and having a plurality of sides, top and bottom walls, and a plurality of first side walls interconnecting said top and bottom walls and disposed respectively at corresponding ones of said sides of said container body, each of said first side walls being formed with an access opening for access into said pill-storing space;

a plurality of first doors connected to said first side walls for closing and opening said access openings in said first side walls, respectively; and a plurality of different first marks, each of which is provided on a respective one of said first side walls or a respective one of said first doors, said first marks respectively representing different times of a day for taking the pills.

2. The portable pill container of claim 1, wherein said times represented by said first marks are arranged in a time ordered manner along a clockwise or a counterclockwise direction.

3. The portable pill container of claim 1, further comprising at least one magnet provided on one of said top and bottom walls.

4. The portable pill container of claim 1, further comprising a plurality of labels attached to said first doors, respectively, said first marks being marked on said labels, respectively.

5. The portable pill container of claim 1, wherein said top and bottom walls are opposite to each other in an alignment direction and have outer surfaces, respectively, said portable pill container further comprising a first engaging member provided at said outer surface of said top wall and having a fool-proof pattern, and a second engaging member provided at said outer surface of said bottom wall and having a fool-proof pattern that overlaps said fool-proof pattern of said first engaging member in the alignment direction.

6. The portable pill container of claim 1, wherein said top and bottom walls are opposite to each other in an alignment direction, each of said first doors being slidable relative to said container body in a transverse direction relative to the alignment direction for closing and opening said access opening in the respective one of said first side walls.

7. The portable pill container of claim 6, wherein each of said first side walls is formed with a slit extending between said top and bottom walls in the alignment direction for extension of a respective one of said first doors that is adjacent and transverse to a corresponding one of said first side walls therethrough.

8. The portable pill container of claim 7, wherein an assembly of said top and bottom walls is formed with a plurality of guiding tracks, each of which includes a pair of guiding grooves formed in said top and bottom walls, respectively, each of said first doors extending slidably into said guiding grooves of a respective one of said tracks.

9. The portable pill container of claim 1, wherein each of said first doors is pivotable relative to said container body for closing and opening said access opening in the respective one of said first side walls.

10. The portable pill container of claim 9, wherein each of said first doors is provided with a pill-receiving tray protruding therefrom, which is disposed in said pill-storing space when said first door is disposed at a close position, and which is disposed outwardly of said pill-storing space when said first door is disposed at an open position.

11. The portable pill container of claim 1, wherein said container body further has at least one second side wall disposed between two adjacent ones of said first side walls and interconnecting said top and bottom walls for preventing access into said pill-storing space therethrough.

12. The portable pill container of claim 11, further comprising a second mark provided on said second side wall and representing an indication of no need to take the pills at a time between two adjacent ones of said times represented by two adjacent ones of said first marks.

13. The portable pill container of claim 1, further comprising at least one second door, said container body further having at least one second side wall disposed between two adjacent ones of said first side walls, interconnecting said top and bottom walls, and formed with an access opening, said second door being fixed to said second side wall for permanently closing said access opening in said second side wall.

14. The portable pill container of claim 13, further comprising a second mark provided on said second door and representing an indication of no need to take the pills at a time between two adjacent ones of said times represented by two adjacent ones of said first marks.

15. A pill storing assembly comprising:

a plurality of pill containers adapted for storing different types of pills, respectively, each of said pill containers including:

a container body defining a pill-storing space and having a plurality of sides, top and bottom walls, and a plurality of first side walls interconnecting said top and bottom walls and disposed respectively at corresponding ones of said sides, said top and bottom walls being opposite to each other in an alignment direction, each of said first side walls being formed with an access opening for access into said pill-storing space, a plurality of first doors connected to said first side walls for closing and opening said access openings in said first side walls, respectively, and a plurality of different first marks, each of which is provided on a respective one of said first side walls or a respective one of said first doors, said first marks respectively representing different times of a day for taking the pills; and an interconnecting mechanism interconnecting said container bodies of said pill containers to form a stack that has a plurality of lateral sides, said interconnecting mechanism having a fool-proof function such that when said stack is formed, said first side walls which are disposed at one of said lateral sides of said stack are aligned along the alignment direction, and that said times represented by said first marks which are disposed at the one of said lateral sides of said stack are always the same.

16. The pill storing assembly of claim 15, wherein said interconnecting mechanism includes a first engaging member provided at said container body of each of said pill containers and having a fool-proof pattern, and a second engaging member provided at said container body of each of said pill containers and having a fool-proof pattern overlapping said fool-proof pattern of said first engaging member in the alignment direction, said first engaging member on each of said pill containers being releasably engageable with said second engaging member of an adjacent one of said pill containers in a tongue-and-groove engaging manner.

17. The pill storing assembly of claim 15, wherein at least one of said pill containers further includes at least one second door, said container body of said at least one of said pill containers further having at least one second side wall disposed between two adjacent ones of said first side walls, interconnecting said top and bottom walls, and formed with an access opening, said second being fixed to said second side wall for permanently closing said access opening in said second side wall.

18. The pill storing assembly of claim 17, wherein said at least one of said pill containers further includes a second mark provided on said second door and representing an indication of no need to take the pills stored in said at least one of said pill containers at a time between said times represented by said first marks on two adjacent ones of said first side walls of said container body of said at least one of said pill containers.

19. The pill storing assembly of claim 15, further comprising a misuse-prevention mechanism that includes a base mounted on a top end of said stack, and a sleeve mounted rotatably on said base and partially surrounding said first side walls of said container body of at least one of said pill containers, said sleeve being formed with a notch and being rotatable relative to said stack so as to position said notch at a selected one of said lateral sides of said stack so that none of said first side walls of said container bodies of said pill containers disposed at said selected one of said lateral sides is surrounded by said sleeve.

20. The pill storing assembly of claim 19, further comprising a date-tracking mechanism including a top cover with a pointer, a date gear wheel having a calendar, and a gear mechanism, said top cover being disposed on a top end of said sleeve and being coupled to said base, said date gear wheel being mounted rotatably in said sleeve, said gear mechanism being mounted in and connected to said sleeve and engaging said date gear wheel so that when said sleeve rotates one full turn, said date gear wheel is driven to rotate an angle to align a next day of said calendar with said pointer.

* * * * *